US010408059B2

(12) United States Patent
Vyvey

(10) Patent No.: US 10,408,059 B2
(45) Date of Patent: Sep. 10, 2019

(54) STATOR WITH ADJUSTABLE VANES FOR THE COMPRESSOR OF AN AXIAL TURBINE ENGINE

(71) Applicant: Safran Aero Boosters SA, Herstal (Milmort) (BE)

(72) Inventor: Morgan Vyvey, Flemalle (BE)

(73) Assignee: Safran Aero Boosters SA (BE)

( * ) Notice: Subject to any disclaimer, the term of this patent is extended or adjusted under 35 U.S.C. 154(b) by 149 days.

(21) Appl. No.: 15/681,781

(22) Filed: Aug. 21, 2017

(65) Prior Publication Data

US 2018/0058220 A1 Mar. 1, 2018

(30) Foreign Application Priority Data

Aug. 30, 2016 (BE) ..... 2016/5664

(51) Int. Cl.

| | |
|---|---|
| ***F01D 9/04*** | (2006.01) |
| ***F01D 17/16*** | (2006.01) |
| ***F01D 25/24*** | (2006.01) |
| ***F01D 5/14*** | (2006.01) |
| *F01D 17/12* | (2006.01) |

(52) U.S. Cl.

CPC ..... *F01D 5/143* (2013.01); *F01D 9/041* (2013.01); *F01D 9/042* (2013.01); *F01D 9/047* (2013.01); *F01D 17/162* (2013.01); *F01D 25/24* (2013.01); *F01D 17/12* (2013.01); *F05D 2220/3217* (2013.01); *F05D 2230/53* (2013.01); *F05D 2240/12* (2013.01); *F05D 2240/14* (2013.01); *F05D 2240/80* (2013.01); *F05D 2270/20* (2013.01); *F05D 2270/3061* (2013.01)

(58) Field of Classification Search

CPC ..... F01D 9/041; F01D 9/042; F01D 9/047; F01D 17/162; F01D 25/24; F05D 2230/53; F05D 2240/14

See application file for complete search history.

(56) References Cited

U.S. PATENT DOCUMENTS

| | | | |
|---|---|---|---|
| 2009/0056306 A1 | 3/2009 | Suciu et al. | |
| 2013/0000324 A1* | 1/2013 | Alvanos | F01D 9/041 60/805 |
| 2014/0182292 A1 | 7/2014 | Hudon et al. | |

(Continued)

FOREIGN PATENT DOCUMENTS

| | | |
|---|---|---|
| EP | 3000984 A1 | 3/2016 |
| WO | 2010026180 A1 | 3/2010 |

OTHER PUBLICATIONS

European Search Report from corresponding Belgium Application No. BE 201605664, dated Apr. 21, 2017.

*Primary Examiner* — Erick R Solis

(74) *Attorney, Agent, or Firm* — Sandberg Phoenis & von Gontard P.C.

(57) ABSTRACT

The invention concerns an assembly for the stator of a compressor of an axial-flow turbine engine, such as a low-pressure compressor of the turbojet engine also known as a booster. The assembly comprises: a first annular array of first vanes of the stator extending radially in the axial flow; and a second annular row of second vanes of the stator, with controlled orientation, also known as variable-pitch vanes or VSV. In addition, the assembly comprises an external monobloc shroud on which the first vanes and the second vanes are mounted in a pivoting manner.

12 Claims, 2 Drawing Sheets

(56) References Cited

U.S. PATENT DOCUMENTS

| | | | | |
|---|---|---|---|---|
| 2016/0024933 | A1* | 1/2016 | Hiernaux | F01D 25/24 415/208.2 |
| 2016/0102571 | A1* | 4/2016 | Cortequisse | F01D 1/20 415/1 |

* cited by examiner

STATOR WITH ADJUSTABLE VANES FOR THE COMPRESSOR OF AN AXIAL TURBINE ENGINE

CROSS-REFERENCE TO RELATED APPLICATIONS

This application claims the benefit, under 35 U.S.C. § 119, of BE 2016/5664 filed Aug. 30, 2016, the disclosure of which is incorporated herein by reference in its entirety.

FIELD

The invention pertains to the field of stators with vanes of controlled orientation for an axial turbine engine. The invention likewise concerns the assembly process of a stator with adjustable vanes. The invention also deals with an axial turbine engine, especially a turbojet engine of an aeroplane or a turboprop engine of an aircraft.

BACKGROUND

At present, several rows of orientable vanes may outfit a stator housing of a compressor of a turbojet engine. Such vanes can pivot during the operation of the engine. Their cambered blades tilt in relation to the primary flow passing through them, making it possible to adapt their action depending on the engine conditions and the flight conditions. The operating range is thus extended, and the efficiency is optimized.

The performance of the compressor is based on the precision of angular positioning of the vanes with respect to the housing, as well as the positioning of the vanes relative to each other. The precision of relative positioning of the vanes is understood both within their row but also in regard to the other rows. In particular, the efficiency requires the vanes to form a blading which best conforms to a predefined geometry.

Document US 2014/0182292 A1 discloses a dual-flow turbofan. The turbofan comprises a low-pressure compressor provided with several rows of vanes, one row of vanes of the stator having a variable geometry. The different rows of vanes of the stator are supported by dedicated external shrouds; these various external shrouds are fixed one after the other by means of radial annular flanges. This configuration enables a mounting when a monobloc bladed disk is present. In fact, the compressor is assembled by alternately securing the rows of rotor vanes and the rows of stator vanes. Each of these rows forms a ring which is brought axially against its support and which radially overlaps the row of vanes downstream from it. Now, this architecture is particularly bulky. Furthermore, the efficiency of such a turbine engine is limited.

SUMMARY

The purpose of the invention is to solve at least one of the problems posed by the prior art. More precisely, the purpose of the invention is to improve the efficiency of a turbine engine with a stator having a controllable geometry. Another purpose of the invention is to propose a compact, tough, light, economical and reliable solution.

The subject of the invention is an assembly for the stator of an axial-flow turbine engine, in particular for the stator of a compressor of an axial-flow turbine engine the assembly comprising: a first annular row of first vanes of the stator extending radially in the axial flow; and a second annular row of second vanes of the stator, with controlled orientation, extending radially in the axial flow; wherein it further comprises an external monobloc shroud on which the first vanes and the second vanes are mounted.

According to various advantageous embodiments of the invention, the second row of vanes is disposed upstream from the first row of vanes.

According to various advantageous embodiments of the invention, the external shroud has a fixation flange at its upstream end, in various instances in the area of the second row of vanes, and in various instances a fixation flange at its downstream end.

According to various advantageous embodiments of the invention, the external shroud comprises a first annular row of orifices at which the first vanes are mounted, and a second annular row of orifices at which the second vanes are mounted.

According to various advantageous embodiments of the invention, the external shroud comprises an annular wall of the same material, and which extends in various instances from the first vanes to the second vanes.

According to various advantageous embodiments of the invention, in the area of and/or between the first vanes and the second vanes, the external shroud comprises an axial portion free of the annular flange, the portion in various instances comprising a generally tubular or substantially truncated outer surface.

According to various advantageous embodiments of the invention, the external shroud comprises an annular segment of constant thickness, or whose thickness varies by at most 30%, or at most 15%; the annular segment being disposed between the first vanes and the second vanes.

According to various advantageous embodiments of the invention, the annular segment extends axially over the majority of the space between the first vanes and the second vanes.

According to various advantageous embodiments of the invention, the assembly comprises a second internal shroud mounted at the internal ends of the second vanes, the second internal shroud having a continuity of circular material.

According to various advantageous embodiments of the invention, the second internal shroud is axially split up into elements, each one having a continuity of circular material.

According to various advantageous embodiments of the invention, the assembly comprises a rotor with a third annular row of third vanes disposed between the first vanes and the second vanes.

According to various advantageous embodiments of the invention, the assembly comprises a synchronization ring disposed around the external shroud.

According to various advantageous embodiments of the invention, the ring is disposed axially between the first vanes and the second vanes.

According to various advantageous embodiments of the invention, the external shroud comprises an inner surface of annular shape whose diameter decreases downstream, in particular along at least one row of vanes or each row of vanes.

According to various advantageous embodiments of the invention, the assembly further comprises a fourth annular row of fourth vanes, the fourth vanes being mounted on the exterior monobloc shroud.

According to various advantageous embodiments of the invention, the diameter of the internal surface decreases in a monotonous or continuous manner.

According to various advantageous embodiments of the invention, the external shroud has a continuity of circumferential material, and in various instances for its entire axial length.

According to various advantageous embodiments of the invention, the external shroud has a continuity of material axially along the first vanes and the second vanes.

According to various advantageous embodiments of the invention, the external shroud is at least monobloc from the first row of orifices to the second row of orifices.

According to various advantageous embodiments of the invention, the second vanes are mounted movable in rotation in the orifices of the second row of orifices.

According to various advantageous embodiments of the invention, the orifices of the second row are configured to enable a guiding in rotation of the second vanes, and/or they are higher radially than the orifices of the first row of orifices.

According to various advantageous embodiments of the invention, the orientation of the second vanes can vary with respect to the first vanes and/or with respect to the external shroud.

According to various advantageous embodiments of the invention, the orientation of the second vanes can vary by at least 10° or 20° or 30°.

According to various advantageous embodiments of the invention, the first vanes and/or the fourth vanes have a fixed orientation, and/or each comprise an internal shroud.

According to various advantageous embodiments of the invention, the fourth vanes are disposed downstream from the first vanes.

According to various advantageous embodiments of the invention, the second shroud comprises means of guidance in rotation, especially of the orifices, cooperating with the second vanes.

The invention likewise concerns a turbine engine having a stator with an assembly, wherein the assembly is according to the invention as set forth above.

According to various advantageous embodiments of the invention, the turbine engine comprises a compressor, the second row of vanes forming the row of vanes upstream from the compressor.

According to various advantageous embodiments of the invention, the turbine engine comprises a housing having an annular vein traversed by the axial flow of the turbine engine, and an axial face, the external shroud being mounted on the axial face, in various instances around the annular vein.

In general, the advantageous embodiments of each subject of the invention are equally applicable to the other subjects of the invention. As much as possible, each subject of the invention can be combined with the other subjects. The subjects of the invention can also be combined with the embodiments in the description, which furthermore can be combined with each other.

The invention makes it possible to improve the efficiency of the turbine engine. For this, it allows a greater precision of positioning of the vanes of at least two annular rows of vanes. The operation of the turbine engine is improved in a broader operating range. The solution proposed by the invention also obeys the constraints of the assembly process, and preserves the simplicity of certain operations.

DRAWINGS

DETAILED DESCRIPTION

In the following description, the terms internal and external refer to a positioning with respect to the axis of rotation of an axial turbine engine. The axial direction corresponds to the direction along the axis of rotation of the turbine engine. The radial direction is perpendicular to the axis of rotation. Upstream and downstream refer to the principal direction of flow of the flow in the turbine engine.

Each vane, whether rotor or stator, has a leading edge, a trailing edge, an intrados surface and an extrados surface, the surfaces joining the leading edge to the trailing edge, like the chords of the vane. In the following description, one can refer to a median chord.

Figure 1:
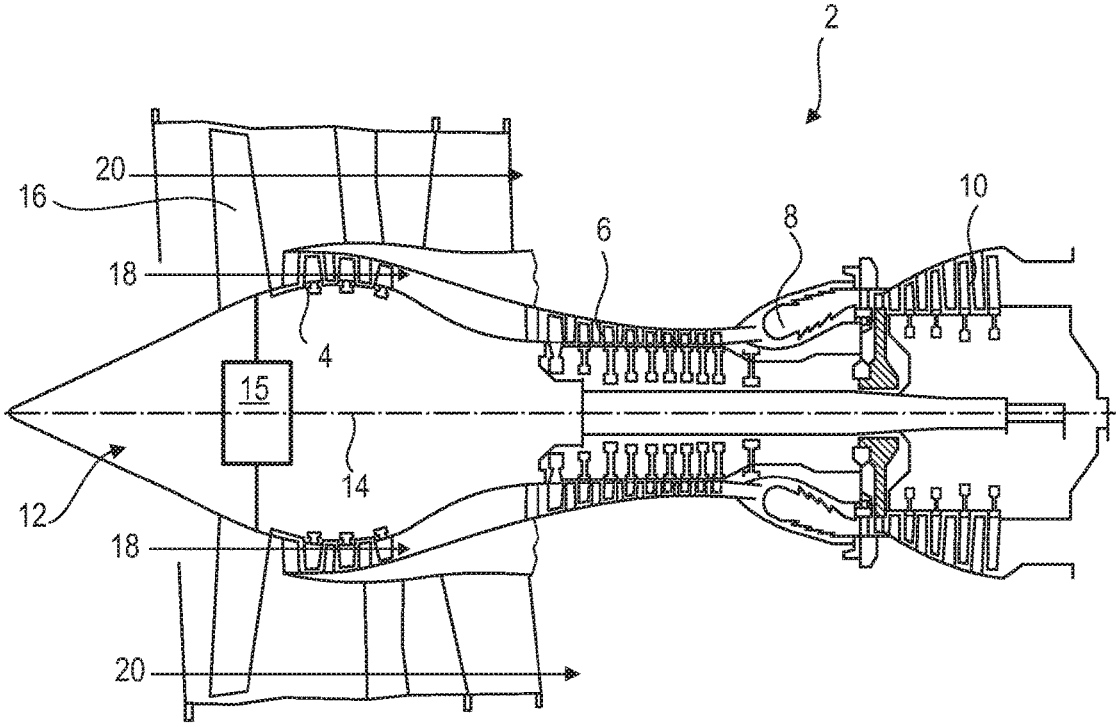
FIG. 1 represents an axial turbine engine according to various embodiments of the invention.

FIG. 1 shows in a simplified manner an axial turbine engine. In this particular instance, it is a dual-flow turbojet engine. The turbojet engine 2 comprises a first compression level, known as the low-pressure compressor 4, a second compression level, known as the high-pressure compressor 6, a combustion chamber 8 and one or more levels of turbines 10. In operation, the mechanical power of the turbine 10 transmitted via the central shaft to the rotor 12 places in motion the two compressors 4 and 6. The latter comprise several rows of vanes of the rotor associated with rows of vanes of the stator. The rotation of the rotor about its axis of rotation 14 thus allows the generating of an air flow and the progressive compressing of the latter up to the entrance into the combustion chamber 8. A transmission 15 with an epicycloid reducing gear can be mounted in the rotor 12.

An entry fan 16 is coupled to the rotor 12 and generates an air flow which is divided into a primary flow 18 passing through the various levels mentioned above of the turbine engine, and a secondary flow 20 passing through an annular conduit (partially shown), generating a thrust which can be used to propel an aeroplane.

Figure 2:
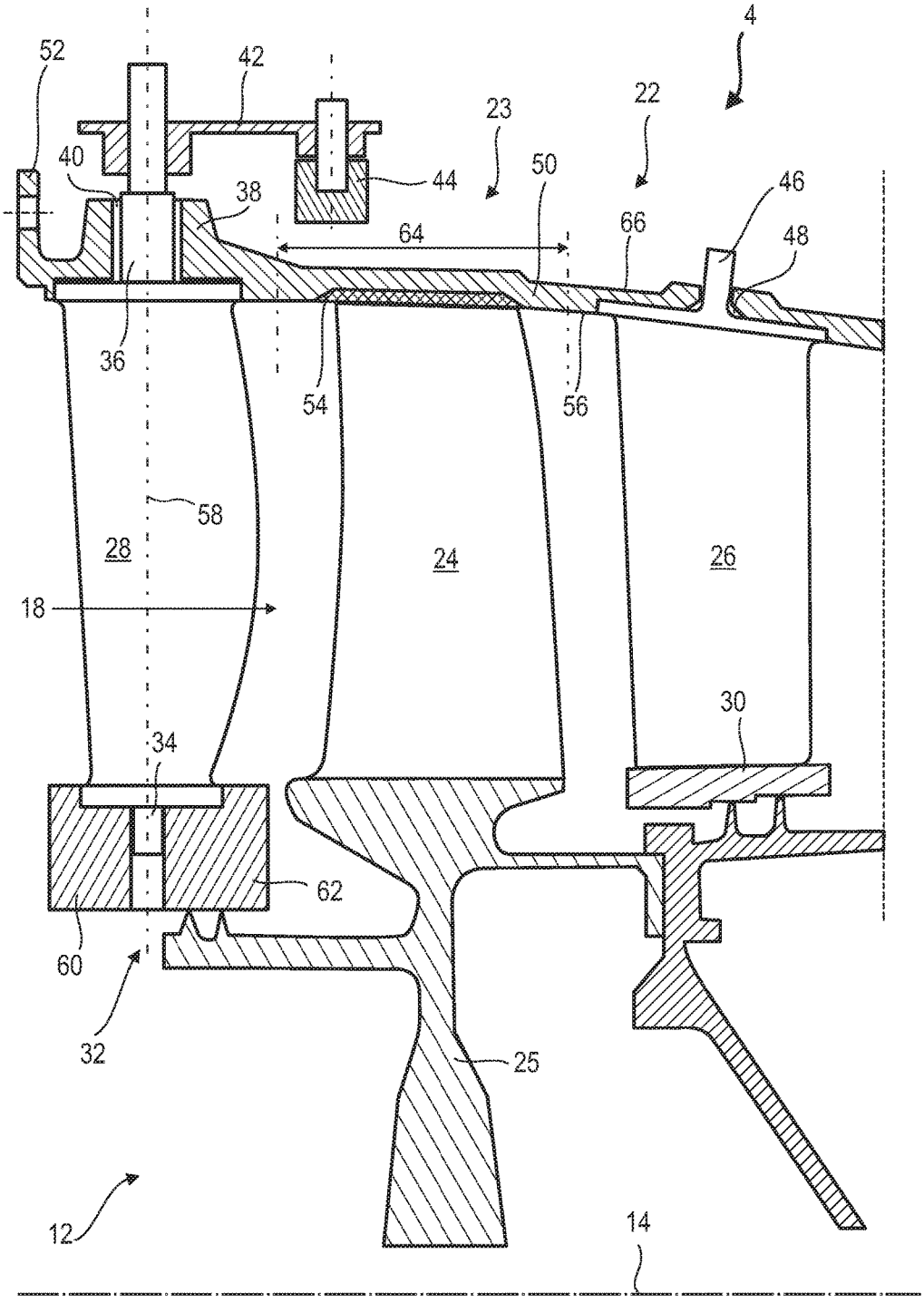
FIG. 2 is a diagram of a portion of the compressor of the turbine engine according to various embodiments of the invention.

FIG. 2 is a cross sectional view of a portion of the compressor of an axial turbine engine like that of FIG. 1. The compressor can be a low-pressure compressor 4.

The compressor comprises a stator 22 with an external monobloc shroud 23. It is of a single material. It describes a closed loop. It has a continuity of circular material and/or a circular homogeneity. It can be monobloc for its entire length. It can comprise a portion made of a single material. The external shroud 23 is fitted about the axis of rotation 14 and surrounds the rotor 12.

The rotor 12 can comprise several rows of rotor vanes 24, such as two or three or more rotor rows, a single row of rotor vanes 24 being visible here. These rotor vanes 24, also called third vanes 24, describe an annular row, called the third row. Despite the rotation of the rotor 12, the inclination in space of the chords of the rotor vanes 24 remains unchanged with respect to the axis of rotation 14. The third vanes 24 can form a monobloc disk; that is, they are indissociable from their support apron 25. Such an arrangement is also known as a "blisk".

The compressor 4 comprises several straighteners, such as at least two, or at least three or lest four straighteners. Each straightener comprises an annular row of stator vanes (26; 28). These vanes are stator vanes in the sense that they are mounted on the stator 22 and thus remain in contact with it. The straighteners are associated with the fan 16 or with a row of rotor vanes 24 to straighten their air flows, so as to convert the speed of the flow into static pressure.

The stator vanes (26; 28) extend substantially radially from the external shroud 23 to the interior. The stator vanes (26; 28) comprise first stator vanes 26 of fixed orientation which form a first annular row, and second stator vanes 28 of controlled orientation that form a second annular row. The stator vanes can likewise comprise a fourth row of fourth vanes (not shown), and in various instances a fifth row of fifth vanes (not shown). These other rows of vanes can be placed downstream from the first vanes 26, which are themselves downstream from the second vanes 28. Each of these rows are axially spaced apart from each other. For example, the first vanes 26 can be separated axially from the second vanes 28 by the annular row of the third vanes 24.

The second vanes 28 are also called variable-pitch vanes, or also VSV for "variable stator vane". Their particularity is that the inclination of their chords can vary with respect to the axis of rotation 14 of the compressor 4, and this during the operation of the turbine engine. Their intrados and extrados faces can be more or less exposed to the primary flow 18. Their orientation can be controlled during the operation of the turbine engine, for example so as to sweep an angle of at least 30°. The stator of the compressor is mixed. It comprises both vanes of controlled orientation, that are thus modifiable, and vanes of fixed orientation. Of course, a single row of vanes with controlled orientation is shown, although this stator could likewise receive more rows of vanes with controlled orientation.

The second vanes 28 can pivot in relation to the flow 18, so that they cover more or less the fluid vein thanks to their blades. They can intercept moreover the primary flow 18. The circumferential width which they occupy can vary. Their leading edges and their trailing edges can move closer to or further away from the vanes of the same row. Being more or less inclined in relation to the general direction of flow, they deviate the primary flow 18 more or less to modulate the flow straightening produced by them. Thus, the turbine engine and the compressor can follow different efficiency curves during the operation, and this on account of a variable geometry of their blading.

The compressor 4 can comprise internal shrouds (30; 32) suspended at the internal ends of the stator vanes (26; 28), a first internal shroud 30 being secured to the first vanes 26, and a second internal shroud 32 with respect to which the second vanes 28 are hinged. In order to allow the rotation of the latter, they have internal pins 34 engaged in the second internal shroud 32. They likewise have external pins 36 passing through the external shroud 23 in the area of bosses 38. The bosses 38 can comprise second orifices 40 enabling a pivot connection with the external pins 36 to be formed. The pins (34; 36) can form cylindrical rods, and they can be made of the same material as their blade. Bearings (not shown) can be provided around the internal pins 34, as well as between the second orifices 40 and the external pins 36. The latter are prolonged by control rods on which are mounted control levers 42 controlled by a synchronization ring 44 which controls each of the second vanes 28 via their control levers 42. An actuator (not shown) of a control system enables controlling the synchronization ring 44, and thus the orientation of the second vanes 28 in the primary flow 18.

The first vanes 26 are fixed and rigidly joined to the external shroud 23 via their rods 46 which are introduced through orifices 48 describing a row, called the first row of orifices 48. A clamping means (not shown) helps freeze the orientation of the first vanes 26. The orifices (40; 48) can be realized during the same phase on the same machine, so that their respective positions are better mastered, and the installation of their vanes (26; 28) better conforms to the predefined geometry.

The stator 22 comprises an annular wall 50. In various instances, it comprises an upstream fixation flange 52, a downstream fixation flange (not shown), and an annular seal 54 which is applied inside the annular wall 50 and which cooperates in a leak tight manner with the third vanes 24 of the rotor 12. The upstream flange 52 forms the upstream end of the wall 50, and allows a fixation on a housing of the turbine engine, for example the upstream housing or the intermediate housing. The wall 50 can be of the same material. It can extend axially all along the second vanes 28 and the first vanes 26, and in various instances all along the fourth vanes. The wall 50 forms a mounting support for the vanes of the stator (26; 28).

According to one option of the invention, the internal surface 56 of the external shroud 23 has an internal diameter which decreases downstream and hugs the external ends of the third vanes 24 mounted on the rotor 12. This configuration thus requires placing the third vanes 24 in the external shroud 23 before mounting the second vanes 28 and their internal shroud 32. The contrary would not be technically feasible, since these second vanes 28 would block the entry of the rotor 12 inside the external shroud 23.

In addition, the second vanes 28 are adjustable. They can pivot on themselves as a result of their external pins 36 that are adjusted in the orifices 40. Hence, their mounting is done by a radial introduction, or along their pivot axes 58 which become their axes of introduction.

In order to allow its mounting, the second internal shroud 32 is split up. It is divided axially into an upstream element 60 and a downstream element 62, each of them forming closed loops. At least one or each of these elements (60; 62) is monobloc, that is, it has a continuity of circular material. One of them can be segmented angularly. At least one of them can cooperate in a leak tight manner with the rotor 12, for example with seal teeth. During the assembly process, the downstream element 62 is placed opposite the third vanes 24. Next, the second vanes 28 are introduced, disposing their internal pins 34 axially facing and radially in the area of the downstream element 62. Next, the upstream element 60 is attached axially against the downstream element 62 while maintaining the internal pins 34 in place. The latter are then locked between the elements (60; 62) while forming a pivot connection; that is, a mechanical connection with a single degree of freedom.

The external shroud 23 comprises a homogeneous axial portion 64. This axial portion 64 can be free of the annular flange, and it can have a generally tubular or substantially truncated exterior surface 66. This exterior surface 66 can be axially continuous. The axial portion 64 can extend over the majority of the space separating the first 26 and second vanes 28, and can have a reduction in diameter from the second vanes 28 towards the first vanes 26.

The axial portion 64 can delimit on the wall 50 an annular segment of constant thickness. In various instances, the thickness of the annular segment can vary axially by at most 20%, or at most 10%. This annular segment is disposed between the first vanes 26 and the second vanes 28, and it can extend axially over the majority of the space between the first vanes 26 and the second vanes 28.

What is claimed is:

1. An assembly of an axial-flow turbine engine, said assembly comprising:

a first annular row of first vanes projecting radially;

a second annular row of second vanes with controlled orientation, the second vanes extending radially and having each a respective internal end;

a one-piece outer shroud on which the first vanes and the second vanes are mounted, and forming a one-piece closed loop about the first vanes and the second vanes, a rotor with a third annular row of third vanes disposed between the first vanes and the second vanes, an inner shroud mounted at the internal ends of the second vanes, the inner shroud having a circular continuity of material, wherein the inner shroud is axially split up into axial elements, each one of the axial elements having a circular continuity of material, and wherein one of the axial elements cooperates with the rotor in a leak tight manner through seal teeth.

2. The stator assembly according to claim 1, wherein the second row of second vanes is disposed upstream from the first row of first vanes.

3. The stator assembly according to claim 1, wherein the one-piece outer shroud has a radial fixation flange at its upstream end, and a radial fixation flange at its downstream end.

4. The stator assembly according to claim 1, wherein the one-piece outer shroud comprises a first annular row of orifices at which the first vanes are mounted, and a second annular row of orifices at which the second vanes are mounted.

5. The stator assembly according to claim 1, wherein the one-piece outer shroud comprises an annular wall of a material which is integrally molded and that projects from the first vanes to the second vanes.

6. The stator assembly according to claim 1, wherein between the first vanes and the second vanes, the one-piece outer shroud comprises an axial portion free of outer annular flange, the axial portion comprising a one of a tubular or substantially truncated outer surface.

7. The stator assembly according to claim 1, wherein the one-piece outer shroud comprises an annular segment having one of a constant thickness or a thickness that varies by at most 30%, the annular segment being disposed between the first vanes and the second vanes.

8. The stator assembly according to claim 7, wherein the annular segment extends axially over more than half of the space between the first vanes and the second vanes.

9. The stator assembly according to claim 1 further comprising a synchronization ring disposed around the one-piece outer shroud.

10. The stator assembly according to claim 9, wherein the synchronization ring is disposed axially between the first vanes and the second vanes.

11. The stator assembly according to claim 1, wherein the one-piece outer shroud comprises an inner surface of annular shape whose diameter decreases downstream, along at least one of the first row and the second row.

12. The stator assembly according to claim 1 further comprising a fourth annular row of fourth vanes, the fourth vanes being mounted on the one-piece outer shroud, the fourth vane being fixed downstream the first vanes and the second vanes.

* * * * *